US005562140A

United States Patent [19]

Biba

[11] Patent Number: 5,562,140

[45] Date of Patent: Oct. 8, 1996

[54] RELEASABLE OPERATING CORD CONNECTOR FOR WINDOW COVERING

[75] Inventor: Scott I. Biba, Mazomanie, Wis.

[73] Assignee: Springs Window Fashions Division, Inc., Middleton, Wis.

[21] Appl. No.: 522,144

[22] Filed: Aug. 31, 1995

[51] Int. Cl.[6] ..... E06B 9/30

[52] U.S. Cl. ..... 160/178.1; 24/115 F

[58] Field of Search ..... 160/178.1 R, 173 R, 160/178.2 R, 320, 321, 168.1 R, 176.1 R, 177 R; 24/115 F, 132 R, 134 R, 132 AA, 132 WL, 136 R; 16/122, 123, 114 B

[56] References Cited

U.S. PATENT DOCUMENTS

| | | | |
|---|---|---|---|
| 3,727,665 | 4/1973 | Debs | 160/178.1 R |
| 3,745,614 | 7/1973 | Tsang | 24/132 R X |
| 3,931,846 | 1/1976 | Zilver | 160/178.2 R |
| 4,909,298 | 3/1990 | Langhart et al. . | |
| 4,967,824 | 11/1990 | Colson et al. . | |
| 5,058,650 | 10/1991 | Morris . | |
| 5,275,222 | 1/1994 | Jelic et al. | 160/178.2 R |
| 5,473,797 | 12/1995 | Wu | 160/178.1 R X |
| 5,504,977 | 4/1996 | Weppner et al. | 24/115 F X |

*Primary Examiner*—David M. Purol
*Attorney, Agent, or Firm*—Vernon J. Pillote

[57] ABSTRACT

A cord connector device for releasably connecting a plurality of operating cords in a window covering. The cord connector device comprises two elongate side members interconnected for relative movement about a pivot axis adjacent their lower ends such that the upper ends of the side members are movable relative to each other in a path of movement from a closed condition to an open condition. Cord retaining jaws extend inwardly of the side members at a location spaced below the upper ends of the side members and the jaws having jaw edges disposed in opposed relation when the side members are in the closed condition to retain the lower ends of the lift cords. A top wall on the upper end of one of the side members configured to form spaced sides and one end of an elongate cord abutment loop and an upper projection on the other side member is arranged to form the other end of the elongate loop when the side members are in the closed condition. Detents releasably retain the upper ends of the first and second side members in a closed condition and are constructed and arranged to release and allow the upper ends to move to the open condition in response to forces on the open condition in response to forces acting on the ends of the cord abutment loop in a direction outwardly of the loop.

21 Claims, 2 Drawing Sheets

FIG. 1
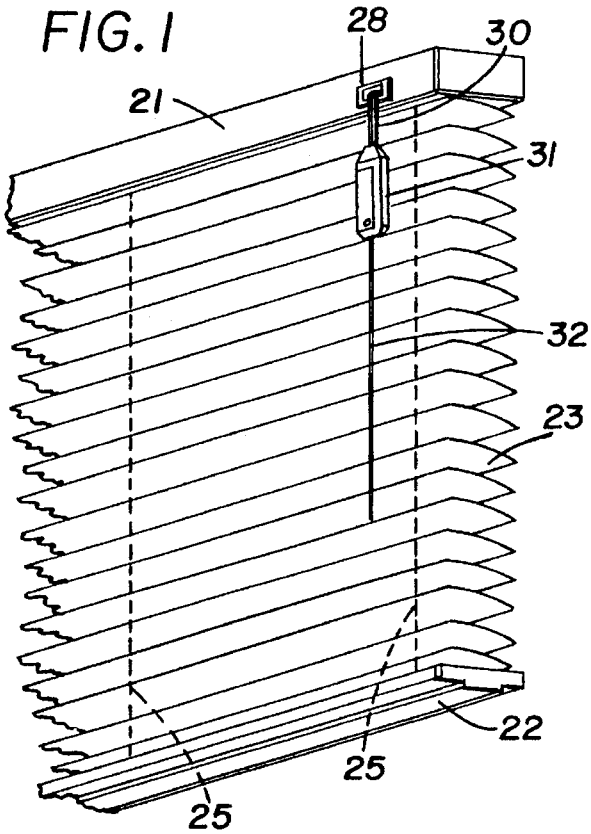
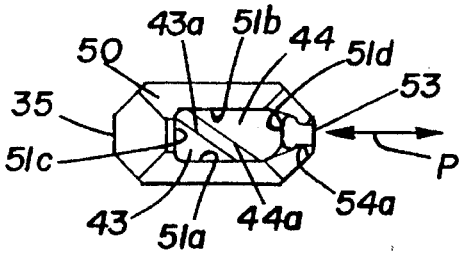
FIG. 10
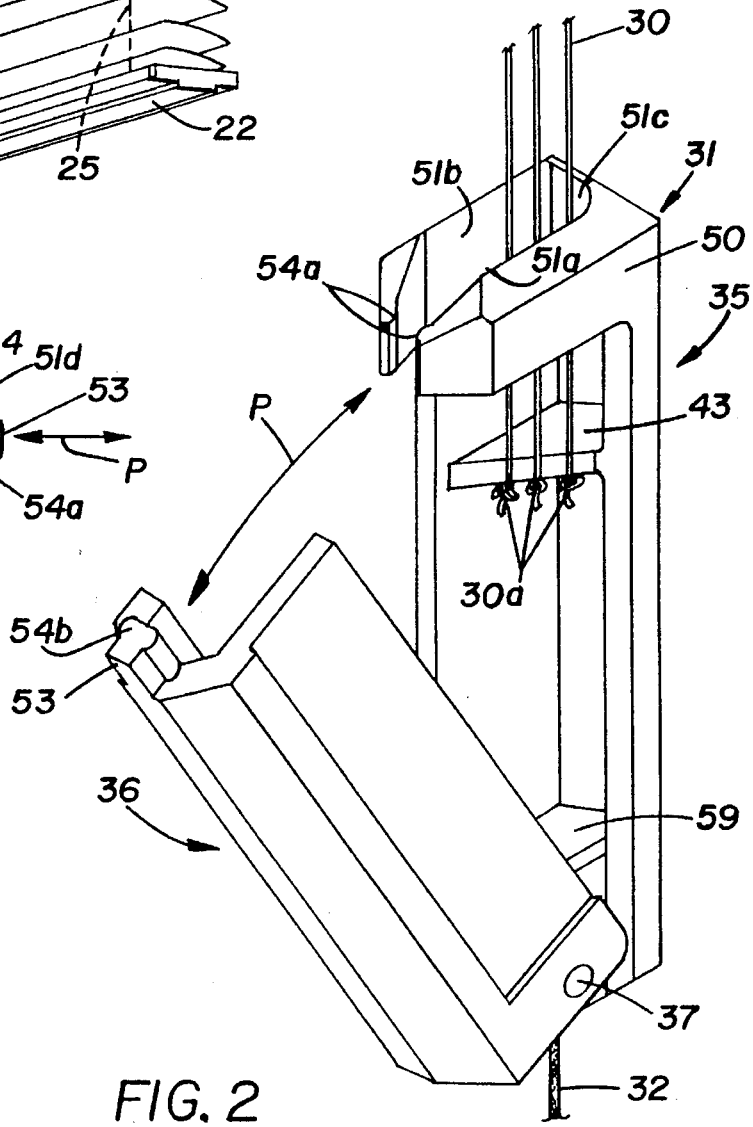
FIG. 2

FIG. 3
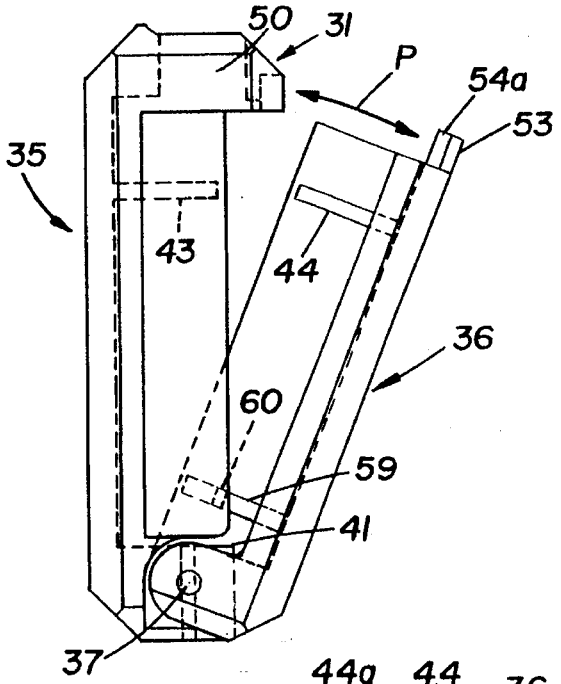
FIG. 4
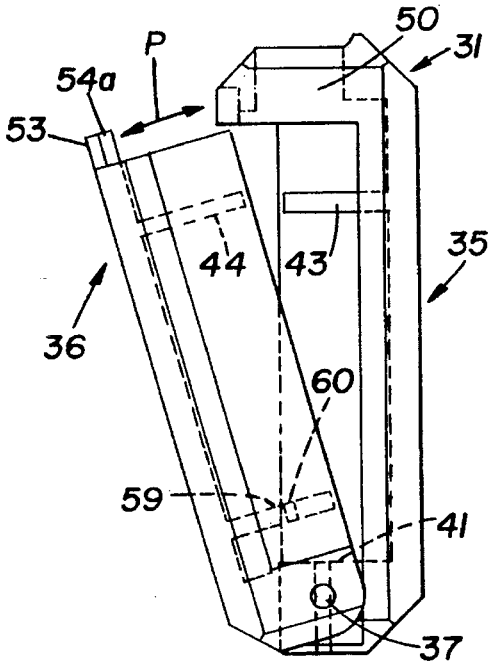
FIG. 8
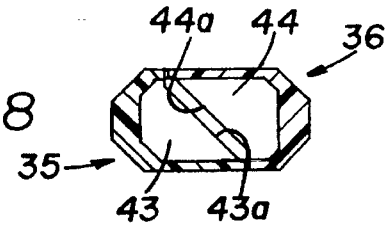
FIG. 9
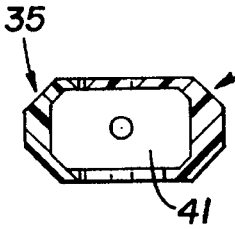
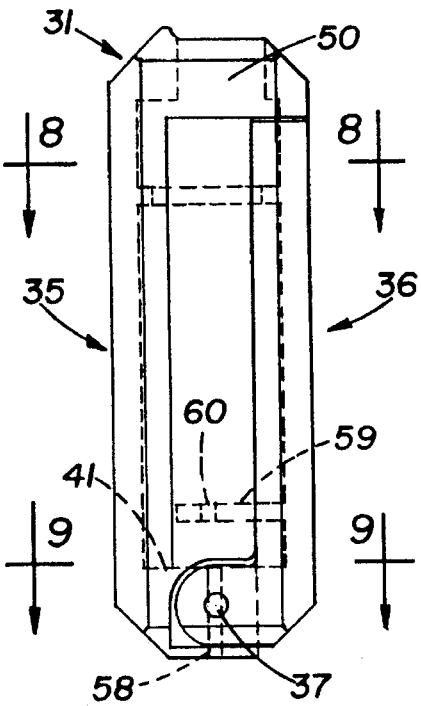
FIG. 5
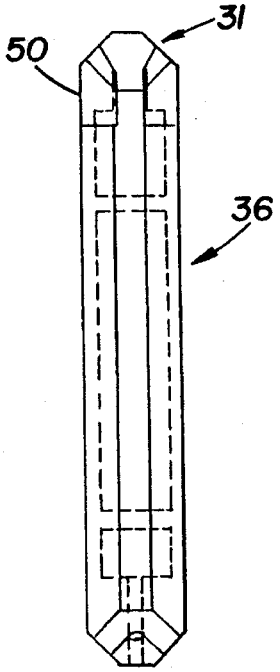
FIG. 6
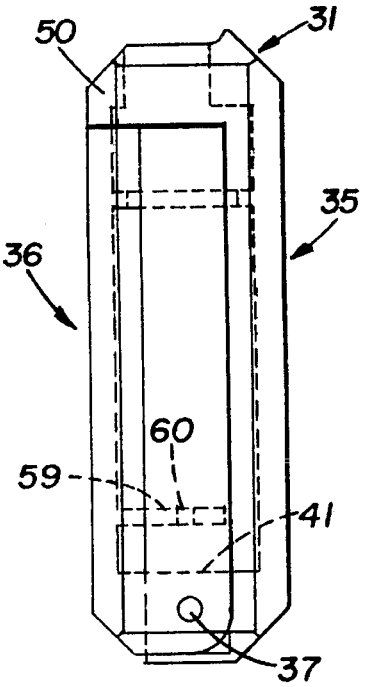
FIG. 7

RELEASABLE OPERATING CORD CONNECTOR FOR WINDOW COVERING

BACKGROUND OF THE INVENTION

Window coverings such as venetian blinds, pleated shades and cellular shades, use two or more lift cords, and in some installations up to eight lift cords. The lift cords are connected at one end to the bottom rail and pass upwardly through the shade to the headrail and then lengthwise along the headrail and through a cord lock, with operating cord portions that extend downwardly as a group from the headrail. In order to maintain the bottom rail horizontal when raising and lowering the window covering, it is necessary to equalize movement of the operating cord portions of the lift cords. In some installations, multiple operating cords are tied together in a knot to equalize movement of the operating cord with a cord pull provided to cover the knot. In some other installations, for example as shown in U.S. Pat. Nos. 4,967,824 and 5,058,650, the multiple operating cords are connected together by a cord equalizer that firmly grips the operating cords to equalize movement and a cord pull is attached to the operating cords at a location below the cord equalizer. As disclosed in the above patents, the user may grasp the operating cords directly or grasp the tassel fixed to the ends of the operating cords, or grab the cord equalizer to raise and lower the blind.

Problems have been encountered when infants or children play with the operating cords and tassels and introduce some limb or their head and neck between some of the operating cords. When the multiple operating cords are permanently interconnected as by a cord equalizer or a cord tassel, the cords can function as a noose that in some cases has caused injury and even the death of a child.

It has heretofore been proposed as disclosed in U.S. Pat. No. 4,909,298 to provide a cord tassel for a window covering having two operating cords, in which the cord tassel consists of two members that are retained on the lower ends of the operating cords and in which the members are detachably connected to each other to enable separation of the lower ends of the two operating cords. Many window covering installations have more than two operating cords and sometimes up to eight operating cords and this markedly complicates the problem of releasably connecting the cords. More particularly, when multiple operating cords are used, the child may become entangled between different operating cords or different groups of the operating cords.

In the co-pending application of Ren Judkins and Nick L. Ross, Ser. No. 08/386,102, filed Feb. 9, 1995, and assigned to the assignee of the present invention, there is disclosed a cord connector device having two side members interconnected adjacent lower ends for pivotal movement relative to each other between a closed condition in which upper portions of the side members are in sidewise adjacent relation and an open condition in which upper portions of the side members are laterally spaced apart. The cord connector device has cord retaining means spaced below the upper ends of the side members, and lateral cord abutment means on the upper ends of the side members arranged to form segments of a closed cord abutment loop that is dimensioned to loosely surround the operating cords. The cord retaining means is arranged to hold the ends of the operating cords against lengthwise movement when the side members are closed and the cord abutment loop is provided to actuate the side members to the open condition in response to forces applied by the operating cords in a direction outwardly of the loop.

SUMMARY OF THE INVENTION

It is an object of the present invention to provide a cord connector device for releasably connecting a plurality of operating cords in a window covering, and which has an improved arrangement for orienting the cord connector device with respect to the direction of the lateral forces on the operating cords, to assure more reliable opening of the cord connector device.

Another object of this invention is to provide a cord connector device in accordance with the foregoing object, in which contact of the upper end of the cord connector device with the object causing separation of the operating cords, does not impede opening of the upper end of the cord connector device.

Accordingly, the present invention provides a cord connector device comprising first and second vertically elongate side members that are pivotally interconnected adjacent the lower end with the upper ends of the side members being movable relative to each other in a path of movement from a closed condition to an open condition. Cord retaining means are provided on the side members at a location spaced below the upper ends of the side members, and cord abutment means are provided on the upper ends of the first and second side members configured to form first and second portions of a horizontally elongate cord abutment loop spaced above the cord retaining means and dimensioned to loosely surround a plurality of operating cords adjacent the upper ends of the side members when the side members are in the closed condition. The elongate cord abutment loop has spaced sides extending generally lengthwise of the path of movement and first and second ends extending generally crosswise, and means are provided for releasably retaining the upper ends of the side members in a closed condition, which means is constructed and arranged to release and allow upper ends of the side members to move to the open condition in response to forces on the first and second ends of the cord abutment loop in a direction outwardly of the loop. This arrangement facilitates orientation of the cord connector device with respect to the direction of the lateral separating forces on the operating cords.

The cord connector device is advantageously formed with a top wall on the first side portion, the top wall having a U-shaped opening elongate in a direction length-wise of the path and open at one end and forming the spaced sides and first end of the elongate cord abutment loop. The second side member has a projection on the upper end for closing the end of the U-shaped opening in the top wall when the side members are in the closed condition. With this arrangement, only the top wall on the first side member engages the object that causes separation of the operating cord above the cord connector device, and the upper end of the second side member is free to move relative to the first side member to an open condition.

BRIEF DESCRIPTION OF THE DRAWINGS

FIG. 1 is a fragmentary perspective view of a window shade in a lowered condition, with a cord connector applied thereto;

FIG. 2 is a perspective view of the cord connector in an open condition;

FIG. 3 is a view of a first side of the cord connector in an open condition;

FIG. 4 is a view of a second side of the cord connector in an open condition;

FIG. 5 is a side view of the first side of the cord connector in a closed condition;

FIG. 6 is an elevational view illustrating one edge of the cord connector;

FIG. 7 is an elevational view illustrating the second side of the cord connector in a closed condition;

FIG. 8 is a transverse sectional view taken on the plane 8—8 of FIG. 5;

FIG. 9 is a transverse sectional view taken on the plane 9—9 of FIG. 5; and FIG. 10 is a top view of the cord connector device.

DETAILED DESCRIPTION

FIG. 1 illustrates a window covering including a headrail 21, a bottom rail 22 and a window covering 23 that extends between the headrail and bottom rail. As used herein, the phrase "window covering" is intended to include any window covering adapted to be extended or collapsed to cover and uncover a window opening and which has two or more operating cords that must be operated together, for example expansible and contractable venetian blinds as illustrated in FIG. 1; expansible and contractable pleated shades; expansible and contractable cellular shades; Roman shades and the like. In general, such window coverings include two or more lift cords 25 which are connected to the movable bottom rail 22 and extend upwardly through or alongside the window covering and into the headrail and then lengthwise through the headrail through a cord lock 28 and terminate in a plurality of downwardly extending lift cord operating portions, hereinafter referred to as operating cords 30. A cord connector device 31 is provided for releasably connecting the multiple operating cords which may comprise from two to eight or more individual operating cords. The cord connector device 31 is adapted to normally hold the multiple operating cords for movement in unison and the user may grip the cord connector device and use it as a cord pull to raise and lower the window covering. It is also contemplated that a single pull cord such as shown at 32 in FIG. 1, can be provided to be gripped by the user for operating the blind when the cord connector is out of reach. A cord tassel can be provided on the lower end of the pull cord to facilitate operation of the pull cord.

The cord connector device 31 extends downwardly from the lower ends of the operating cords 30 and the terms upper, lower and vertical applied to the cord connector refer to its normal orientation when hanging from the operating cords. The cord connector includes first and second side members 35 and 36 that are interconnected for relative movement about a pivot axis 37 adjacent their lower ends. The upper ends of the side members are movable relative to each other in a path of movement P from a closed condition as shown in FIGS. 5–7 to an open condition as shown in FIGS. 2–4. The side members are preferably configured to conform a vertically elongate hollow body having a major cross-sectional dimension disposed in a plane paralleling the path of movement P and perpendicular to the pivot axis 37. One of the side members 35 has a base 41 formed integrally with its lower end and trunnions formed integrally with the base extend into openings in the lower end of the other side member to interconnect the side members for pivotal movement about the axis 37.

Cord retaining means are provided on the side members and include jaws 43, 44 on the side members 35 and 36 at a location spaced below the upper ends of the side members. The jaws have jaw edges 43*a*, 44*a* disposed in opposed relation when the side members are in the closed condition, with at least portions of the jaw edges spaced apart a distance to accommodate the cross-section of individual operating cords 30. The jaw edges can be formed with cusps along the length to space the cords or can be formed smooth as shown. The jaws provide downwardly facing shoulders at the underside adapted to engage a cord stop 30*a* such as a knot, bead or other enlargement on the lower ends of the operating cord which are larger than the spacing between the jaws 43*a*, 44*a*.

Cord abutment means are provided on the upper ends of the side members 35, 36 and configured to form a cord abutment loop that is elongated in a direction paralleling the path of movement P and having opposed sides 51*a*, 51*b* and opposed ends 51*c* and 51*d*. The cord loop loosely surrounds the operating cords 30 at the upper end of the connector device so that the operating cords can move relative to each other in the cord loop. The path of relative movement of the upper ends of the side members P is disposed in a plane perpendicular to the pivot axis and when an object is inserted between the operating cords 30 at a location above the connector device, the operating cords will tend to move laterally in two separated groups between the side walls 51*a* and 51*b* of the abutment loop, and cause the connector device to orient with its major transverse axis generally in the plane of the separated cord loops.

The connector device is preferably constructed and arranged so that the object introduced between the operating cords cannot simultaneously engage the upper ends of both side members and thereby inhibit operation of the side members. Accordingly, a top wall 50 is formed on the upper end of one of the side members 35 with a U-shaped opening that is elongate in a direction lengthwise of the path P. The opening in the top wall forms opposite sides 51*a*, 51*b* and one end 51*c* of the elongated cord abutment loop, and a second portion of the cord abutment loop is formed by a projection 53 on the upper end of the side member 36. As will be seen, the upper surfaces of the top wall extend above the upper end of the projection 53. The projection 53 is arranged to close the open end of the U-shaped opening in the top wall 50 when the side members are opposed to form the second end portion 51*d* of the abutment loop. Means for releasably retaining the side members in a closed condition is constructed and arranged to release and allow the upper ends of the side members to move to the open condition in response to forces acting on the first and second ends of the cord abutment loop in a direction outwardly of the loop. The closure retaining means is advantageously formed by interengaging detents 54*a* and 54*b* on the open end of the top wall 50 and the projection 55 on side member 36.

The side members 35, 36 are conveniently formed with generally L-shaped configuration arranged to form a cord connector device having an oblong cross-section when the side members are in a closed condition. As best shown in FIGS. 2, 8 and 10 the jaw edge 43*a* is generally diagonally between the side edges of side member 35, and the jaw edge 44*a* on side member 36 extends in parallel spaced relation to the edge 44*a*.

The cord connector device is shaped and adapted to be gripped by one hand and to function as a cord pull. A pull cord 32 can be used and for this purpose a pull cord passage 58 is provided in the base 41. A pull cord can be inserted through the passage 58 and a cord abutment such as a knot or bead can be provided on the pull cord at a location above the base. In the embodiment shown, means are also provided to aid in holding the side members in the closed condition in response to a downward pull on the pull cord 32. For this purpose, a panel 59 is formed on the side member 36 at a location spaced above the base 41 and an opening 60 provided in the panel at a location generally aligned with the passage 58. The end of the pull cord can be inserted through opening 60 in the panel and an abutment provided on the cord above the panel. With this arrangement, a downward pull on the pull cord 32 will draw the side member 36 toward the closed condition.

The embodiments of the invention in which an exclusive property or privilege is claimed are defined as follows:

1. A cord connector device for releasably connecting a plurality of operating cords in a window covering, the cord connector device comprising first and second elongate side members each having an upper and a lower end, means interconnecting the first and second side members for relative movement about a pivot axis adjacent the lower ends, the upper ends of the side members being movable relative to each other in a path of movement from a closed condition to an open condition, cord retaining means including a jaw extending from each of the side members at a location spaced below the upper ends of the side members, the jaws having jaw edges disposed in opposed relation when the side members are in the closed condition with at least portions of the jaw edges being spaced apart a distance to accommodate the cross-section of individual operating cords, the jaws providing downwardly facing shoulders at the underside thereof adapted to engage a cord stop on the operating cords, cord abutment means on the upper ends of the first and second side members configured to form first and second portions of a cord abutment loop spaced above the cord retaining means and dimensioned to loosely surround a plurality of operating cords adjacent the upper end of the side members, when the side members are in the closed condition, said cord abutment loop being elongate in a direction generally parallel to said path of movement and having spaced sides and first and second ends, and means for releasably retaining the upper ends of the first and second side members in the closed condition, said last mentioned means being constructed and arranged to release and allow the upper ends of the side members to move to the open condition in response to forces on the first and second ends of the cord abutment loop in a direction outwardly of the loop.

2. A cord connector device according to claim 1 wherein the first portion of the cord abutment loop includes a top wall on the first side member having a U-shaped opening elongate in a direction lengthwise of said path and open at one end and forming the spaced sides and the first end of the elongate cord abutment loop, said second portion of the cord abutment loop including a projection on the upper end of the second side member for closing said one end of the U-shaped opening in the top wall when the side members are in the closed condition.

3. A cord connector device according to claim 1 wherein said top wall is elongate in a direction lengthwise of the path of movement.

4. A cord connector device according to claim 3 wherein the cord connector device has an oblong cross-sectional configuration with a major transverse dimension generally paralleling said path of movement, the pivot axis extending transverse to the major transverse dimension.

5. A cord connector device according to claim 4 wherein said first and second side members each have a generally L-shaped cross-sectional configuration.

6. A cord connector according to claim 5 wherein the side members have lengthwise extending side edges, the jaw edges on each side member extending between the lengthwise extending edges.

7. A cord connector device according to claim 1 wherein the jaw edges on the first and second side members are disposed at an acute angle with respect to said path of movement.

8. A cord connector device according to claim 1 wherein said last mentioned means includes interengaging detent means on said top wall and said projection.

9. A cord connector device for releasably connecting a plurality of operating cords in a window covering, the cord connector device comprising first and second elongate side members each having an upper and a lower end, means interconnecting the first and second side members for relative movement about a pivot axis adjacent the lower ends, the upper ends of the side members being movable relative to each other in a path of movement from a closed condition to an open condition, cord retaining means including a jaw extending from each of the side members at a location spaced below the upper ends of the side members, the jaws having jaw edges disposed in opposed relation when the side members are in the closed condition with at least portions of the jaw edges being spaced apart a distance to accommodate the cross-section of individual operating cords, the jaws providing downwardly facing shoulders at the underside thereof adapted to engage a cord stop on the operating cords, cord abutment means on the upper ends of the first and second side members configured to form first and second portions of a cord abutment loop spaced above the cord retaining means and dimensioned to loosely surround a plurality of operating cords adjacent the upper end of the side members, when the side members are in the closed condition, said cord abutment loop being elongate in a direction generally parallel to said path of movement and having spaced sides first and second ends, the first portion of the cord abutment loop including a top wall on the first side member having a U-shaped opening elongate in a direction lengthwise of said path and open at one end and forming the spaced sides and the first end of the elongate cord abutment loop, said second portion of the cord abutment loop including a projection on the upper end of the second side member for closing said one end of the U-shaped opening in the top wall when the side members are in the closed condition, means for releasably retaining the upper ends of the first and second side members in a closed condition, said last mentioned means being constructed and arranged to release and allow the upper ends of the side members to move to the open condition in response to forces on the first and second ends of the cord abutment loop in a direction outwardly of the loop.

10. A cord connector device according to claim 9 wherein said top wall is elongate in a direction lengthwise of the path of movement.

11. A cord connector device according to claim 9 wherein the cord connector device has an oblong cross-sectional configuration with a major transverse dimension generally paralleling said path of movement, the pivot axis extending transverse to the major transverse dimension.

12. A cord connector device according to claim 9 wherein said first and second side members each have a generally L-shaped cross-sectional configuration.

13. A cord connector according to claim 12 wherein the side members have lengthwise extending side edges, the jaw edges on each side member extending between the lengthwise extending between the lengthwise extending edges.

14. A cord connector device according to claim 9 wherein the jaw edges on the first and second side members are disposed at an acute angle with respect to said path of movement.

15. A cord connector device according to claim 9 wherein said last mentioned means includes interengaging detent means on said top wall and said projection.

16. A cord connector device for releasably connecting a plurality of operating cords in a window covering, the cord connector device comprising first and second elongate side members each having a generally L-shaped cross-section and an upper and a lower end, means interconnecting the first and second side members for relative movement about a pivot axis adjacent the lower ends, the upper ends of the side members being movable relative to each other in a path of movement from a closed condition to an open condition, the side members being configured to form an elongate hollow body having a major cross-sectional dimension in a plane paralleling said path of movement and perpendicular to the pivot axis, cord retaining means including a jaw on each of the side members at a location spaced below the upper ends of the side members, the jaws having jaw edges disposed in opposed relation when the side members are in the closed condition with at least portions of the jaw edges being spaced apart a distance to accommodate the cross-section of individual operating cords, the jaws providing downwardly facing shoulders at the underside thereof adapted to engage a cord stop on the operating cords, cord abutment means on the upper ends of the first and second side members configured to form first and second portions of a cord abutment loop spaced above the cord retaining means and dimensioned to loosely surround a plurality of operating cords adjacent the upper end of the side members, when the side members are in the closed condition, said cord abutment loop being elongate in a direction extending generally parallel to said path of movement and having spaced sides and first and second ends, and means for releasably retaining the upper ends of the first and second side members in a closed condition, the last mentioned means being constructed and arranged to release and allow the upper ends to move to the open condition in response to forces on the open condition in response to forces acting on the first and second ends of the cord abutment loop in a direction outwardly of the loop.

17. A cord connector device according to claim 16 wherein the first portion of the cord abutment loop includes a top wall on the first side member having a U-shaped opening elongate in a direction lengthwise of said path and open at one end and forming the spaced sides and the first end of the elongate cord abutment loop, said second portion of the cord abutment loop including a projection on the upper end of the second side member for closing said one end of the U-shaped opening in the top wall when the side members are in the closed condition.

18. A cord connector device according to claim 17 wherein said first and second side members each have a generally L-shaped cross-sectional configuration.

19. A cord connector according to claim 18 wherein the side members have lengthwise extending side edges, the jaw edges on each side member extending between the lengthwise extending edges.

20. A cord connector device according to claim 18 wherein the jaw edges on the first and second side members are disposed at an acute angle with respect to said path of movement.

21. A cord connector device according to claim 17 wherein said means for releasably retaining the first and second side members in the closed condition includes interengaging detent means on said top wall and said projection.

* * * * *